US011281163B2

(12) United States Patent
Zanesco et al.

(10) Patent No.: US 11,281,163 B2
(45) Date of Patent: Mar. 22, 2022

(54) ELECTRONIC TIMEPIECE WITH A MOTION SENSOR

(71) Applicant: ETA SA Manufacture Horlogere Suisse, Grenchen (CH)

(72) Inventors: Vittorio Zanesco, Neuchatel (CH); Pascal Lagorgette, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 149 days.

(21) Appl. No.: 16/819,432

(22) Filed: Mar. 16, 2020

(65) Prior Publication Data

US 2020/0301369 A1 Sep. 24, 2020

(30) Foreign Application Priority Data

Mar. 22, 2019 (EP) ..... 19164604

(51) Int. Cl.
*G04C 3/00* (2006.01)
*G04B 19/04* (2006.01)
*G04C 10/00* (2006.01)

(52) U.S. Cl.
CPC ..... *G04C 3/00* (2013.01); *G04B 19/04* (2013.01); *G04C 10/00* (2013.01)

(58) Field of Classification Search
CPC . G04C 3/14; G04C 9/00; G04C 3/001; G04C 10/00; G04C 3/00; G04C 3/002;
(Continued)

(56) References Cited

U.S. PATENT DOCUMENTS 3,921,385 A * 11/1975 Harding ..... G04G 9/10 368/69
3,963,885 A * 6/1976 Brien ..... G04C 3/002 200/52 R
(Continued)

FOREIGN PATENT DOCUMENTS

CN 1256442 A 6/2000
CN 102998969 A 3/2013
(Continued)

OTHER PUBLICATIONS

European Search Report dated Sep. 18, 2019 in European Application 19164604.1 filed on Mar. 22, 2019 (with English Translation of Categories of Cited Documents), citing documents AA-AC & AO therein, 3 pages.
(Continued)

*Primary Examiner* — Edwin A. Leon
(74) *Attorney, Agent, or Firm* — Oblon, McClelland, Maier & Neustadt, L.L.P.

(57) ABSTRACT

An electronic timepiece with a first and second electric motors for driving time indicating hands with a set of gear wheels, and a microcontroller connected to the motion sensor and controlling each motor. A motion sensor includes a movable element arranged to move freely inside a structure connected to the timepiece movement. As a function of the position and movement of the moving element inside the housing, a first and second electric signals, different from each other, are generated by the motion sensor for the microcontroller in a defined time period to determine whether the timepiece is in use. If only one electric signal is detected by the microcontroller in the defined time period, the timepiece changes into a sleep mode, by stopping at least the first electric motor intended to drive the seconds hand.

12 Claims, 3 Drawing Sheets

(58) Field of Classification Search
CPC ..... G04B 19/04; G04G 19/12; G04G 9/0041; H01H 35/02; H01H 35/025; H01H 2300/054
USPC ..... 368/80
See application file for complete search history.

(56) References Cited

U.S. PATENT DOCUMENTS

| | | | | |
|---|---|---|---|---|
| 4,036,007 | A * | 7/1977 | Shelley | G04C 3/002 368/69 |
| 4,095,408 | A * | 6/1978 | Kashio | G04G 9/126 368/69 |
| 4,899,132 | A | 2/1990 | Stobbe et al. | |
| 5,612,931 | A | 3/1997 | Sato et al. | |
| 5,946,274 | A | 8/1999 | Yamaguchi et al. | |
| 6,693,851 | B1 | 2/2004 | Fujisawa et al. | |
| 2003/0209654 | A1 | 11/2003 | Smith | |
| 2012/0050057 | A1 | 3/2012 | Dery et al. | |

FOREIGN PATENT DOCUMENTS

| | | | |
|---|---|---|---|
| CN | 103399483 | A | 11/2013 |
| CN | 204515354 | U | 7/2015 |
| CN | 105122182 | A | 12/2015 |
| EP | 1 098 234 | B1 | 12/2006 |
| FR | 2 365 834 | A1 | 4/1978 |
| JP | 2002-55177 | A | 2/2002 |
| JP | 3525897 | B2 | 5/2004 |
| JP | 2006-208342 | A | 8/2006 |
| JP | 2007-26688 | A | 2/2007 |

OTHER PUBLICATIONS

Combined Chinese Office Action and Search Report dated Mar. 10, 2021 in Patent Application No. 202010185795.3 (with English language translation and English translation of Category of Cited Documents), citing documents AB, AC, and AQ-AV therein, 21 pages.

* cited by examiner

ELECTRONIC TIMEPIECE WITH A MOTION SENSOR

CROSS-REFERENCE TO RELATED APPLICATIONS

This application claims priority to European Patent Application No. 19164604.1 filed on Mar. 22, 2019, the entire disclosure of which is hereby incorporated herein by reference.

FIELD OF THE INVENTION

The invention relates to an electronic timepiece with a motion sensor. The timepiece has an analogue time display using hands driven by one or more electric motors and via a set of gear wheels.

BACKGROUND OF THE INVENTION

Generally, an electronic timepiece, such as an electromechanical wristwatch, operates with an electric power battery or cell. In the case where the time is displayed in an analogue manner by means of hands, every type of means is sought to reduce electrical consumption when the wristwatch is not used, i.e. no longer worn on a user's wrist.

EP Patent No. 0 194 136 B1 discloses an electronic timepiece for indicating the time with a plurality of hands respectively driven by a plurality of motors. It is possible to envisage stopping at least one of the motors when the supply voltage from a voltage source drops below a predetermined value in order to limit the amount of electricity consumed. The electric power can be supplied by one or more solar cells. When it is restarted and all the motors are driven, the timepiece is corrected and driven to indicate the current time by correcting the time that was suspended as a result of one of the motors stopping. There is no disclosure, however, concerning a motion sensor of such a timepiece for reducing electrical consumption in the event of absence of motion or of the timepiece being unused.

An electronic timepiece, such as an electromechanical watch, can also be provided with motion sensors to control various functions. CH Patent No. 604 359 A and FR Patent Application No. 2 365 834 A1 disclose a gravity actuated switch in a wristwatch according to a movement made by said watch. To achieve this, a conductive ball can contact at least two conductive terminals, acting as a switch to close an electric circuit connected to an electrical power supply and, for example, to control the illumination of the time to be displayed. However, it is not intended to stop part of the watch operating when the latter is removed from the wrist to be placed, in particular, in a sleep mode.

EP Patent Application No. 0 857 977 A1 and U.S. Pat. No. 5,946,274 disclose a detection device for detecting an acceleration. In a first closed casing of the device, several electrode pins are arranged parallel to one another and a conductive ball is arranged to move inside an area surrounded by the electrode pins. The conductive ball is normally held on one side by the magnetic force of a magnet, but as soon as an acceleration is applied to the device, the conductive ball moves against the magnetic holding force of the magnet to contact two electrode pins and deliver a detection signal. However, it is not intended to stop part of the watch operating when the latter is removed from the wrist to be placed, in particular, in a sleep mode.

It is thus an object of the present invention to overcome the problems identified above relating to electronic timepieces with an analogue time display.

SUMMARY OF THE INVENTION

The present invention therefore proposes an electronic timepiece with a motion sensor and an analogue time display, as explained in more detail below.

To this end, the present invention concerns an electronic timepiece with a motion sensor and an analogue time display according to the independent claims 1 to 4.

One advantage of the electronic timepiece with a motion sensor lies in the fact that the motion sensor comprises a movable element arranged to move freely inside a housing of a structure connected to the timepiece movement. When the timepiece is in use and as a function of the position and motion of the movable element inside the housing, a first electric signal and a second electric signal, different from the first electric signal, are generated by the motion sensor. These two electric signals are detected by the microcontroller in a defined time period to determine whether the timepiece is in use. In the case where only one electric signal is detected by the microcontroller in the defined time period, the timepiece changes into a sleep mode, stopping at least one electric motor intended to drive the time indicating hands.

Advantageously, by stopping the first motor driving the seconds hand while the watch is not worn on the wrist, for example, it is possible to still have a time display via the hour and minute hands, particularly to allow the time to be read during the night.

Advantageously, after the timepiece has been placed in sleep mode, the timepiece can rapidly be reactivated with all the hands rapidly reset to the correct time when in use.

Advantageously, all the components for performing the stop and reactivation function are very simple and thus inexpensive.

Advantageously, with such a motion sensor, it is possible to detect a motion or change of orientation in all directions, with practically no possibility of equilibrium.

Other aspects of the present invention are defined in the dependent claims.

BRIEF DESCRIPTION OF THE DRAWINGS

The objects, advantages and features of an electronic timepiece with a motion sensor and analogue time display will appear more clearly in the following non-limiting description made with reference to the drawings, in which.

DETAILED DESCRIPTION OF THE INVENTION

In the following description, all those components of a timepiece with analogue time display, such as an electromechanical watch, which are well known to those skilled in the art in this technical field, will be described only in a simplified manner. The timepiece essentially comprises a timepiece movement, preferably provided with two electric motors, which are controlled by a microcontroller having a time base circuit, for driving the time indicating hands.

Figure 1:
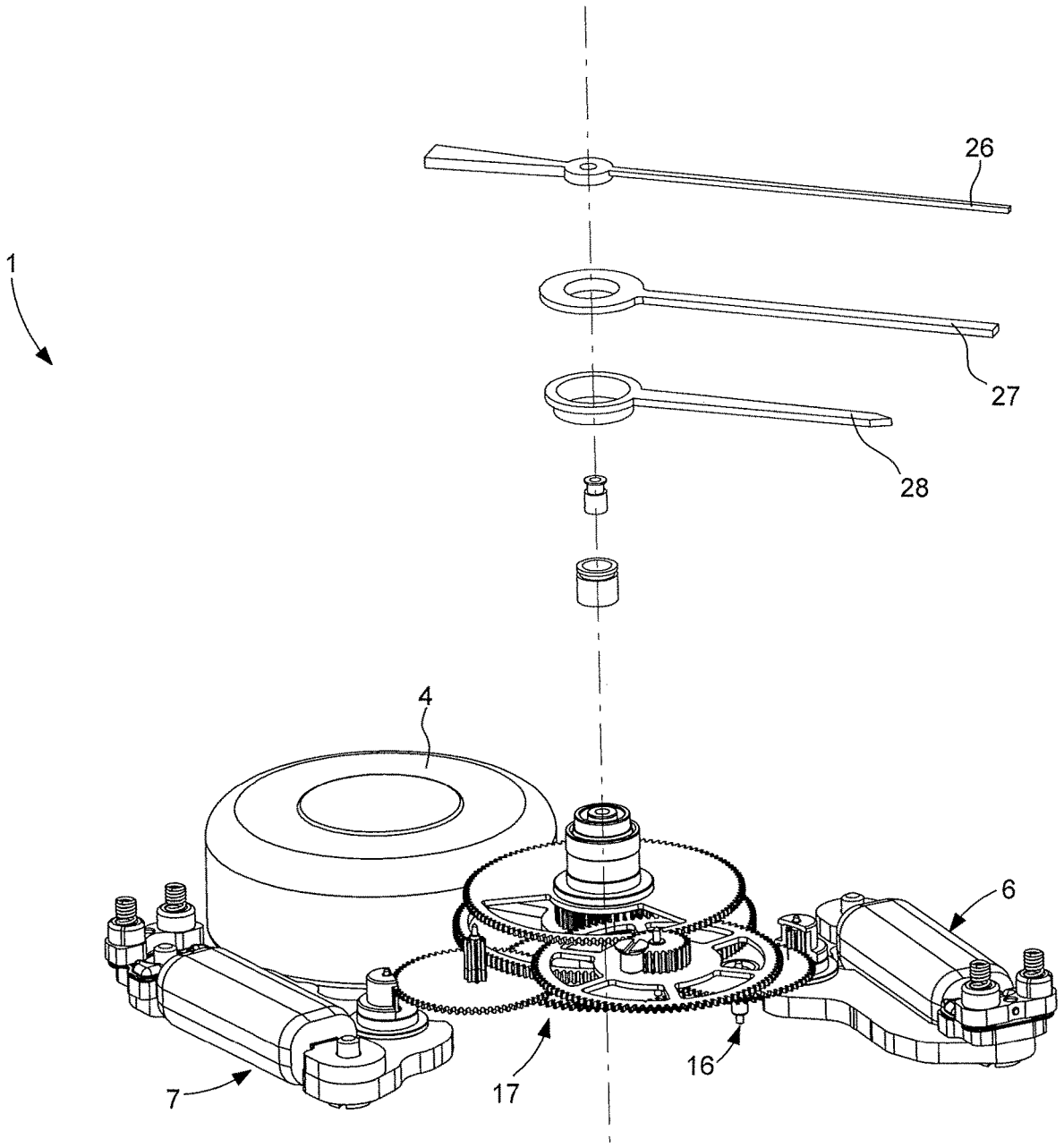
FIG. 1 represents a schematic, partially exploded three-dimensional view illustrating the main components of an electronic timepiece with an analogue time display according to the invention.

Referring to FIG. 1, electronic timepiece 1, such as an electromechanical watch, which is schematically represented, comprises an electric power source 4 consisting of a battery, which powers an electronic circuit, such as a microcontroller (not represented). At least one electric motor 6, 7 is provided for driving time indicating hands 26, 27, 28 by means of gear wheels 16, 17. At least the hour hand 28 and minute hand 27 can be arranged to indicate the time, but, as represented in FIG. 1, there may also be a seconds hand 26. Electric motor 6, 7 is controlled by the microcontroller connected to the motor and powered by the cell or battery 4. A motion sensor (not represented) can be placed beside battery 4, for example, and connected to the microcontroller to detect any motion during use of timepiece 1, which may be an electromechanical wristwatch.

Preferably, timepiece 1 comprises a first electric motor 6 and a second electric motor 7 for driving hour hand 28, minute hand 27 and seconds hand 26 by means of a set of gear wheels 16, 17. The first electric motor 6 drives only seconds hand 26 via a first well-known type of gear train 16, while second electric motor 7 drives hour hand 28 and minute hand 27 via a second well-known gear train 17.

Figure 2:
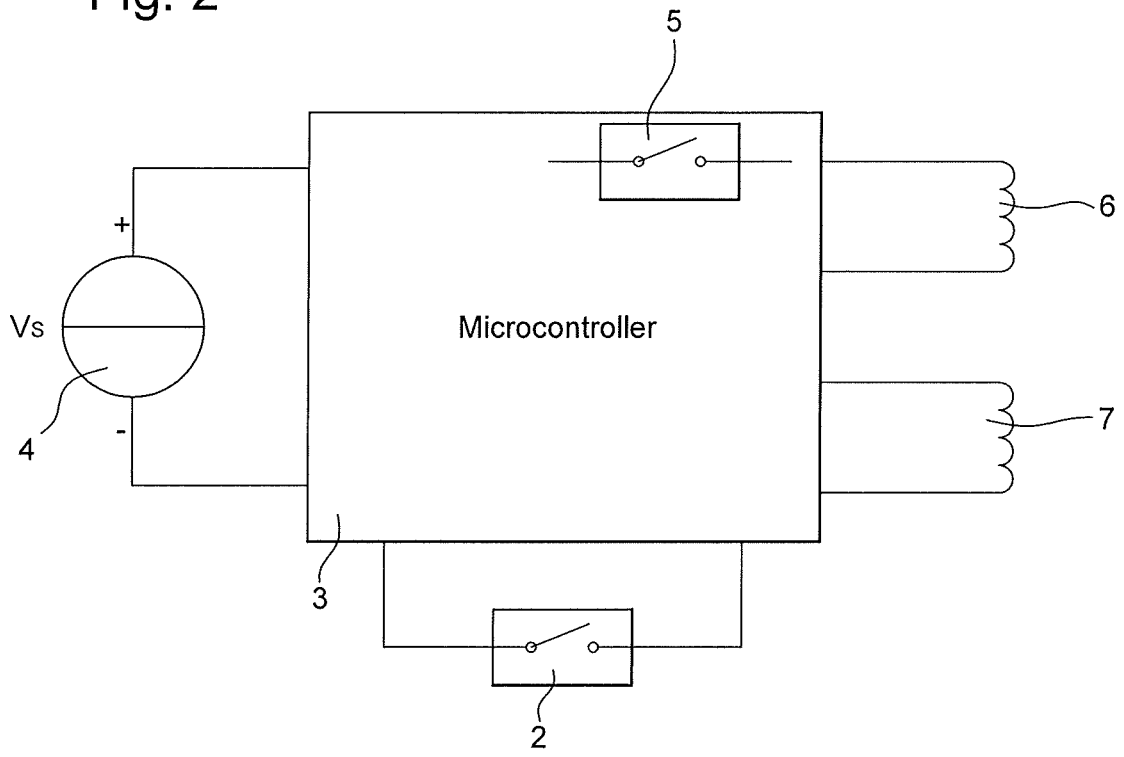
FIG. 2 represents a schematic view of various electronic blocks of an electronic timepiece with the time displayed by hands and with a motion sensor according to the invention.

FIG. 2 schematically represents various electronic blocks of the electronic timepiece with analogue time display by means of hands and with a motion sensor 2. A microcontroller 3 is powered by a battery or cell 4, or by a power source, such as solar cells or a heat generator or other source of electrical energy extraction. Microcontroller 3 may comprise a time base circuit with a quartz resonator oscillator for clocking all the operations and calculating the time to be displayed by the timepiece hands. Microcontroller 3 is connected to a motion sensor 2 generating, with microcontroller 3, one or more electric signals as a function of a movement of the timepiece as explained below. Microcontroller 3 controls the driving of the motor(s) 6, 7. Mainly, microcontroller 3 controls first electric motor 6 to drive the seconds hand, and second electric motor 7 to drive the hour and minute hands.

Motion sensor 2, described in more detail with reference to FIGS. 3 to 9 below, mainly comprises a movable element arranged to move freely inside a housing of a structure connected to the timepiece movement. While the movable element is moving inside its housing, a first electric signal and a second electric signal, different from the first electric signal, are generated by the motion sensor in conjunction with microcontroller 3. Thus, microcontroller 3 is capable of detecting the two electric signals representative of the movement of the timepiece in a defined time period. If only one electric signal is detected by microcontroller 3 in the defined time period, the timepiece is capable of changing into a sleep mode, particularly when the timepiece, such as an electromechanical wristwatch, is placed, for example, on a table at rest when not in use. In such case, microcontroller 3 can stop the electric motor(s) 6 and 7, or, preferably, stop first electric motor 6 as symbolised by a switch 5 in conjunction with the connection to first electric motor 6. By stopping only first electric motor 6, it is possible to keep the time display by the hour and minute hands, which may be useful during the night in order to view the time by hands coated with a phosphorescent or fluorescent layer. There may be a gain in autonomy of more than 25% during around 6 hours of daily inactivity by stopping only first electric motor 6 in sleep mode.

It is to be noted that after the motor(s) has/have been stopped to reduce electrical consumption in periods of non-use of the timepiece, electric motor(s) 6 and 7 can be reactivated immediately. This occurs as soon as the timepiece is used again once microcontroller 3 detects two electric signals from motion sensor 2. As microcontroller 3 includes time counters and the placement of one or more hands in a determined stop position, reactivation of the timepiece and resetting of the time display by the hands occurs automatically. In the case where only first electric motor 6 is stopped, the seconds hand can be automatically placed at 12 o'clock, for example, in sleep mode.

It is to be noted that the defined time period for detection of the two electric signals can be programmed according to the requirements of timepiece users. This time period may be set, for example, at 30 minutes, but other values could also be envisaged. Each electric signal can also be defined as an electrical state, i.e. a voltage level.

Figure 3:
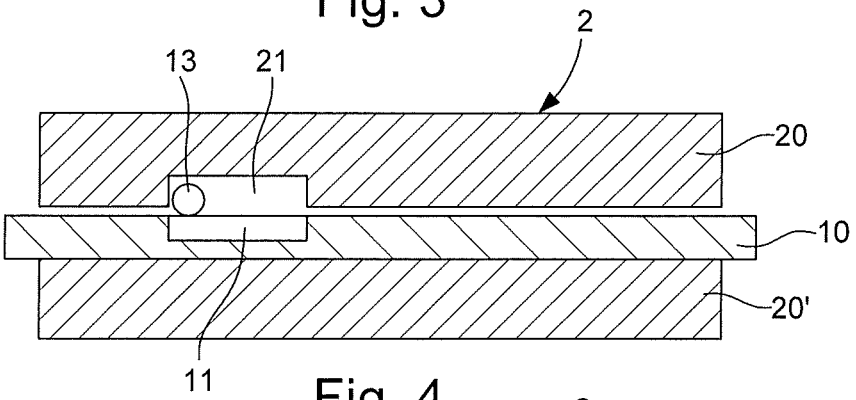
FIG. 3 represents a first embodiment according to a first principle of a motion sensor of the electronic timepiece with analogue time display according to the invention.

FIG. 3 represents a first embodiment according to a first principle of a motion sensor 2 of the electronic timepiece with analogue time display. Movable element 13 is a conductive ball 13, such as a golden ball, which is mounted to move freely inside housing 21 to act as an electric contactor, notably to connect, like a switch, two connection terminals of an electric circuit forming part, for example, of the microcontroller. Housing 21 may be a cavity made in a structure 20, which may be a support plate of the timepiece movement. Conductive ball 13 is confined between cavity 21 of plate 20 and a printed circuit board 10, on which an electrical connection pad 11 is formed. The portion of structure 20 that includes housing 21 is not in contact with printed circuit board 10. Conductive paths, such as insulated metal paths, are made on printed circuit board 10 to connect, in particular, said electrical connection pad 11 to the microcontroller.

There is sufficient space between the bottom of housing or cavity 21 and electrical connection pad 11 to allow conductive ball 13 to rest in the bottom of the cavity without contact with electrical connection pad 11, or to come in contact with said electrical connection pad 11 without contact with the bottom of the cavity. The metal portion of structure 20, which includes housing 21 can be connected to one of the power source terminals, for example at zero potential, while electrical connection pad 11 can be at a potential defined by the microcontroller obtained, for example, by a resistive or capacitive divider connected to the positive terminal of the supply voltage source. Thus, depending on the movement of conductive ball 13 inside housing 21, two electric signals may be generated for the microcontroller: a first electric signal at zero potential if the conductive ball touches an edge of housing 21 and electrical connection pad 11, and a second electric signal at a defined potential, if conductive ball 13 is simply at the bottom of housing 21 without contact with electrical connection pad 11. As long as the two electric signals are detected by the microcontroller in the defined time period, the operation of the timepiece does not change with all the motors running.

It is to be noted that the structure comprises a complementary portion 20', arranged underneath printed circuit board 10 as a support for said printed circuit board 10 and ensuring the holding thereof, so that electrical connection pad 11 closes housing 21 of structure 20.

Figure 9:
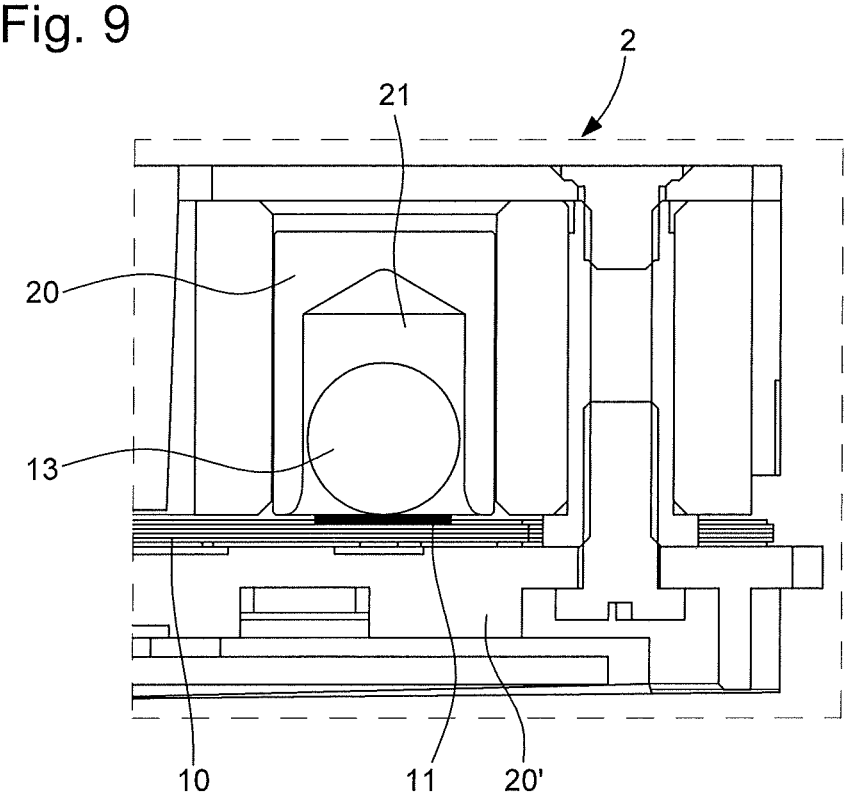
FIG. 9 represents a more detailed embodiment relative to the first embodiment of FIG. 3, in a sectional view of a motion sensor of the electronic timepiece with analogue time display according to the invention.

According to a more detailed variant, FIG. 9 represents a sectional view of a motion sensor 2 of the electronic timepiece. This variant is based on the first embodiment of FIG. 3. Motion sensor 2 comprises a conductive ball 13, for example made of metal, arranged inside a housing 21 of a portion of structure 20 and above a printed circuit board 10 on which electrical connection pad 11 is made. A complementary portion 20' of the structure can support printed circuit board 10, leaving electrical connection pad 11 without contact with the edges of housing 21 of the portion of structure 20. Ball 13 can move freely inside tubular housing 21 between the bottom of housing 21 and electrical connection pad 11. In this manner, the microcontroller can detect the two electric signals when the electromechanical wristwatch is worn by a user.

Figure 4:
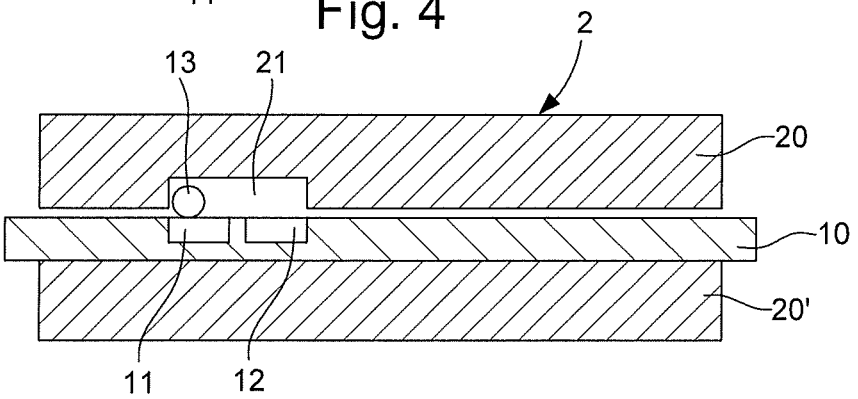
FIG. 4 represents a second embodiment according to a first principle of a motion sensor of the electronic timepiece with analogue time display according to the invention.

FIG. 4 represents a variant of the embodiment of FIG. 3 according to a first principle of a motion sensor 2 of the electronic timepiece. The only difference lies in the fact that two electrical connection pads 11, 12 are made on printed circuit board 10. The microcontroller will detect changes in potential across the two electrical connection pads 11, 12 and hence the two electric signals according to the same principle described above with reference to FIG. 3.

FIGS. 5 to 8 represent embodiments according to a second principle of a motion sensor of the electronic timepiece with analogue time display through the detection of a variation in a magnetic field picked up by at least one magnetic sensor for the generation of two electric signals detected by the microcontroller.

Figure 5:
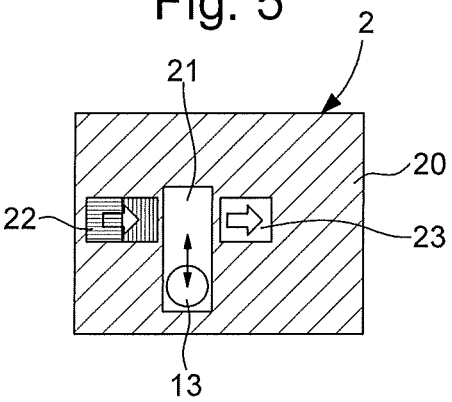
FIG. 5 represents a third embodiment according to a second principle of a motion sensor of the electronic timepiece with analogue time display according to the invention.

FIG. 5 represents a third embodiment according to a second principle of a motion sensor 2 of the electronic timepiece with analogue time display.

A ball 13, forming the movable element, is arranged inside a housing 21 of a structure 20, which may be in two parts secured to one another but is not represented. Ball 13 may be made of ferromagnetic material. The length of housing 21 may be at least twice the diameter of ball 13, whereas the width and depth can be slightly greater than the diameter of ball 13 to allow it to move freely inside housing 21. A permanent magnet 22 is arranged on one part of the length of housing 21 and inside structure 20, and a magnetic sensor 23 is arranged on one part of the length of housing 21 on an opposite side to permanent magnet 22 and facing permanent magnet 22 in structure 20. Permanent magnet 22 generates a magnetic field directed towards magnetic sensor 23. Magnetic sensor 23 is capable of periodically detecting a magnetic change in its close environment to supply a first electric signal or a second electric signal to the microcontroller as a function of the position of the ball moving inside housing 21.

A magnetic sensor 23 is used, which changes electrical state after a determined detection threshold. When ball 13 is in the area between permanent magnet 22 and magnetic sensor 23, a change occurs in the magnetic field detected by the magnetic sensor. Thus, a first electric signal is generated by magnetic sensor 23 for the microcontroller below or above the determined detection threshold. Conversely, when the ball is away from the area between permanent magnet 22 and magnetic sensor 23, a second electric signal, different from the first electric signal, is generated by magnetic sensor 23 for the microcontroller.

Since the power consumption of such a magnetic sensor is at a low level, this makes it possible to make such measurements every second, for example. When there are changes in orientation of the watch with moving ball 13, the magnetic field read by magnetic sensor 23 will change and pass above or below the determined detection threshold. This allows two electric signals to be supplied to the microcontroller in a defined time period to determine whether the watch is in use with all the motors operating.

Figure 6:
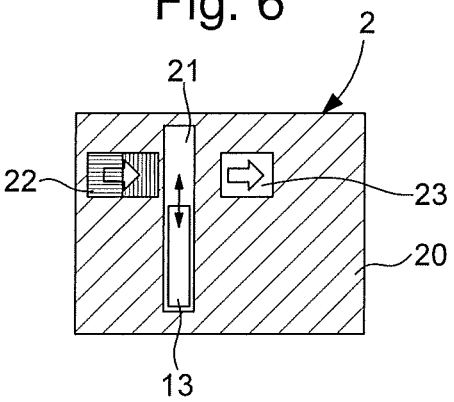
FIG. 6 represents a fourth embodiment according to a second principle of a motion sensor of the electronic timepiece with analogue time display according to the invention.

FIG. 6 represents a fourth embodiment according to a second principle of a motion sensor 2 of the electronic timepiece.

The only difference with respect to the third embodiment of FIG. 5, is that the movable element is a ferromagnetic disc 13 arranged inside housing 21. The length of housing 21 can be at least one and a half or two times the diameter of disc 13, whereas the width and depth can be slightly greater than the thickness or the diameter of disc 13 to allow it to move or roll freely inside housing 21 to a position between permanent magnet 22 and magnetic sensor 23 and a position away from permanent magnet 22 and magnetic sensor 23. Two electric signals can be generated for the microcontroller in a defined time period to determine whether the watch is in use with all the motors operating.

Figure 7:
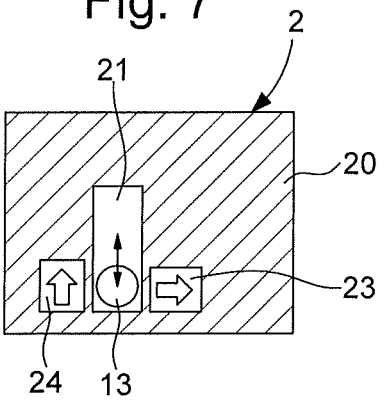
FIG. 7 represents a fifth embodiment according to a second principle of a motion sensor of the electronic timepiece with analogue time display according to the invention.

FIG. 7 represents a fifth embodiment according to a second principle of a motion sensor 2 of the electronic timepiece.

This fifth embodiment differs from the third embodiment in that ball 13 is magnetized and arranged to move freely inside housing 21 of a non-magnetic or non-metal structure, for example. A first magnetic sensor 23 is arranged on one part of the length of housing 21 and inside structure 20, and a second magnetic sensor 24 is arranged on one part of the length of housing 21 on a side opposite first magnetic sensor 23 and facing first magnetic sensor 23 in structure 20. First magnetic sensor 23 has an orientation orthogonal to second magnetic sensor 24. First magnetic sensor 23 and/or second magnetic sensor 24 are capable of periodically detecting a magnetic change in their close environment to supply a first electric signal or a second electric signal to the microcontroller as a function of the position of ball 13 inside housing 21. The first electric signal and the second electric signal are generated below and above a determined detection threshold by each magnetic sensor 23, 24 or by at least one of the magnetic sensors for the microcontroller in a defined time period to determine whether the watch is in use with all the motors operating.

Figure 8:
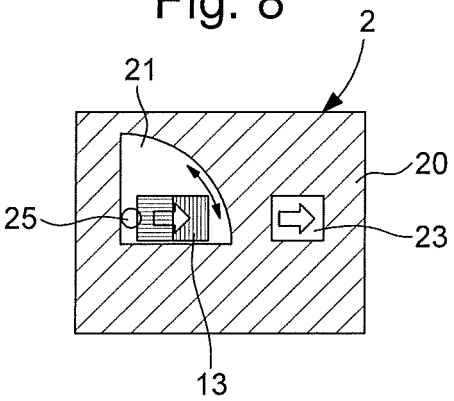
FIG. 8 represents a sixth embodiment according to a second principle of a motion sensor of the electronic timepiece with analogue time display according to the invention.

Finally, FIG. 8 represents a sixth embodiment according to a second principle of a motion sensor 2 of the electronic timepiece.

Moving element 13 is formed of a permanent magnet 13 arranged inside a housing 21 of structure 20. The permanent magnet is mounted to rotate freely about an axis 25 inside a quarter circle-shaped housing 21. Magnetic sensor 23 is arranged inside structure 20 perpendicular to axis of rotation 25 and, for example, in the extension of a rectilinear portion of housing 21. A first electric signal and a second electric signal are generated for the microcontroller below or above a detection threshold determined by a magnetic sensor 23 as a function of the position, near or far, of permanent magnet 13. If both electric signals are generated in a defined time period for the microcontroller, it is determined that the watch is in use with all the motors operating. Otherwise, at least the motor of the seconds hand is stopped in sleep mode, as in the other embodiments of FIGS. 3 to 7.

From the description that has just been given, several variants of the electronic timepiece with a motion sensor can be devised by those skilled in the art without departing from the scope of the invention defined by the claims.

The invention claimed is:

1. An electronic timepiece with an analog time display and a motion sensor, the timepiece comprising:

a timepiece movement provided with at least one electric motor configured to drive time indicating hands with a set of gear wheels, and a microcontroller connected to the motion sensor to control the at least one electric motor, wherein the motion sensor comprises a conductive ball arranged to move freely inside a housing of a structure connected to the timepiece movement and confined between the housing and a printed circuit board, on which there is made at least one electrical connection pad connected to the microcontroller, wherein a metal portion of the structure which includes the housing is not in contact with the printed circuit board, wherein there is space between a bottom of the housing and the electrical connection pad, and wherein, as a function of a position and movement of a moving element inside the housing, the microcontroller is configured to detect a first electric signal and a second electric signal, different from the first electric signal, generated by the motion sensor, in a defined time period to determine whether the timepiece is in use, and when only one electric signal is detected by the microcontroller in the defined time period, the timepiece is configured to change into a sleep mode by stopping the at least one electric motor configured to drive the hands.

2. An electronic timepiece with an analog time display and a motion sensor, the timepiece comprising:

a timepiece movement provided with at least a first electric motor and a second electric motor configured to drive the hour, minute, and seconds hands with a set of gear wheels, and a microcontroller connected to the motion sensor to control each of the first electric motor and the second electric motor, wherein the motion sensor comprises a conductive ball arranged to move freely inside a housing of a structure connected to the timepiece movement and confined between the housing and a printed circuit board, on which is made at least one electrical connection pad connected to the microcontroller, wherein a metal portion of the structure that includes the housing is not in contact with the printed circuit board, wherein there is space between a bottom of the housing and the electrical connection pad, and wherein as a function of a position and movement of a moving element inside the housing, the microcontroller is configured to detect, a first electric signal and a second electric signal, different from the first electric signal, generated by the motion sensor, in a defined time period to determine whether the timepiece is in use, and when only one electric signal is detected by the microcontroller in the defined time period, the timepiece is configured to change into a sleep mode, by stopping the first electric motor, which is configured to drive the seconds hand.

3. An electronic timepiece with an analog time display and a motion sensor, the timepiece comprising:

a timepiece movement provided with at least one electric motor to drive time indicating hands with a set of gear wheels, and a microcontroller connected to the motion sensor to control the at least one electric motor, wherein the motion sensor includes a movable element arranged to move freely inside a housing of a structure connected to the timepiece movement, the movable element being made of ferromagnetic material to move into the housing between a permanent magnet and a magnetic sensor, or the movable element being magnetized or in the form of a permanent magnet for detection of a variation in a magnetic field detected by the magnetic sensor in order to generate two electric signals detected by the microcontroller, and wherein, as a function of a position and movement of the moving element inside the housing, the microcontroller is configured to detect a first electric signal and a second electric signal, different from the first electric signal, generated by the motion sensor, in a defined time period to determine whether the timepiece is in use, and when only one electric signal is detected by the microcontroller in the defined time period, the timepiece is configured to change into a sleep mode, by stopping the at least one electric motor configured to drive the hands.

4. An electronic timepiece with an analog time display and a motion sensor, the timepiece comprising:

a timepiece movement provided with at least a first electric motor and a second electric motor to drive hour, minute, and seconds hands with a set of gear wheels, and a microcontroller connected to the motion sensor to control each of the first electric motor and the second electric motor, wherein the motion sensor includes a movable element arranged to move freely inside a housing of a structure connected to the timepiece movement, the movable element being made of ferromagnetic material to move into the housing between a permanent magnet and a magnetic sensor, or the movable element being magnetized or in the form of a permanent magnet for detection of a variation in a magnetic field detected by the magnetic sensor in order to generate two electric signals detected by the microcontroller, and wherein, as a function of a position and movement of the moving element inside the housing, the microcontroller is configured to detect a first electric signal and a second electric signal, different from the first electric signal, generated by the motion sensor, in a defined time period to determine whether the timepiece is in use, and when only one electric signal is detected by the microcontroller in the defined time period, the timepiece is configured to change into a sleep mode by stopping the first electric motor, which is configured to drive the seconds hand.

5. The timepiece according to claim 1, wherein the microcontroller includes a time base circuit and is configured to detect the first electric signal and the second electric signal from the motion sensor after a sleep mode during use of the timepiece for the immediate activation of the at least one electric motor and resetting of the time indicated by the time indicating hands.

6. The timepiece according to claim 1, wherein the metal portion of the structure that includes the housing is at zero potential, wherein the space between the bottom of the housing and the electrical connection pad allows the conductive ball to rest in the bottom of the housing without contact with the electrical connection pad, which is at a potential defined by the microcontroller, or to come into contact with said electrical connection pad without contact with the bottom of the housing to impose zero potential on the electrical connection pad in order to define a first electric signal and a second electric signal, different from the first electric signal, for the microcontroller.

7. The timepiece according to claim 6, wherein the printed circuit board comprises two electrical connection pads connected to the microcontroller.

8. The timepiece according to claim 3, wherein the movable element is a hall made of ferromagnetic material, arranged to move freely inside the housing, wherein the length of the housing is at least two times a diameter of the ball, whereas a, width and a depth of the housing are substantially greater than the diameter of the ball, wherein a permanent magnet is arranged on one part of a length of the housing inside the structure, wherein the magnetic sensor is arranged on one part of the length of the housing on an opposite side to the permanent magnet and facing the permanent magnet inside the structure, and wherein the magnetic sensor is configured to periodically detect a magnetic change in an environment of the magnetic sensor to supply the first electric signal or the second electric signal to the microcontroller as a function of a position of the ball inside the housing.

9. The timepiece according to claim 8, wherein the magnetic sensor changes electrical state after a determined detection threshold, depending on the position of the ball inside the housing, the first electric signal is generated by the magnetic sensor for the microcontroller below or above the determined detection threshold, and the second electric signal, different from the first electric signal, is generated for the microcontroller when the hall is away from an area between the permanent magnet and the magnetic sensor.

10. The timepiece according to claim 3, wherein the movable element is a disc made of ferromagnetic material, arranged to move freely inside the housing, wherein a length of the housing is at least one and a half times a diameter of the disc, whereas a width and a depth of the housing are substantially greater than a thickness and the diameter of the disc, wherein the permanent magnet is arranged on one part of the length of the housing inside the structure, wherein the magnetic sensor is arranged on one part of the length of the housing on an opposite side to the permanent magnet and facing the permanent magnet in the structure, and wherein the magnetic sensor is configured to periodically detect a magnetic change in an environment of the magnetic sensor to supply the first electric signal or the second electric signal to the microcontroller as a function of a position of the disc inside the housing.

11. The timepiece according to claim 3, wherein the movable element is a magnetized ball arranged to move freely inside the housing, wherein a first magnetic sensor is arranged on one part of a length of the housing inside the structure, wherein a second magnetic sensor is arranged on one part of the length of the housing on a side opposite the first magnetic sensor and facing the first magnetic sensor in the structure, wherein the first magnetic sensor has an orientation orthogonal to the second magnetic sensor, and wherein the first electric signal and the second electric signal are generated by at least one of the first and second magnetic sensors for the microcontroller as a function of a position and a movement of the ball inside the housing in a defined time period to determine whether the timepiece is in use, and when only one electric signal is generated for the microcontroller, the timepiece is in the sleep mode.

12. The timepiece according to claim 3, wherein the movable element is a permanent magnet arranged inside the housing of the structure, the permanent magnet being mounted to rotate freely about an axis of rotation in a quarter circle-shaped housing, wherein the magnetic sensor is arranged inside the structure perpendicular to the axis of rotation, and wherein the first electric signal and the second electric signal are generated for the microcontroller above or below a detection threshold determined by the magnetic sensor as a function of a position, near or far, of the permanent magnet with respect to the magnetic sensor in a defined time period to determine whether the timepiece is in use, and when only one electric signal is generated for the microcontroller, the timepiece is in the sleep mode.

* * * * *